US005218265A

United States Patent [19]

Reidinger

[11] Patent Number: 5,218,265

[45] Date of Patent: Jun. 8, 1993

[54] COMBINED MASK-FRAME WITH DOUBLE SPOT WELDS

[75] Inventor: Rolf Reidinger, Ortsstrasse, Fed. Rep. of Germany

[73] Assignee: Nokia (Deutschland) GmbH, Pforzheim, Fed. Rep. of Germany

[21] Appl. No.: 839,695

[22] Filed: Feb. 20, 1992

Related U.S. Application Data

[63] Continuation of Ser. No. 537,041, Jun. 12, 1990, abandoned.

[30] Foreign Application Priority Data

Jun. 16, 1989 [DE] Fed. Rep. of Germany ..... 3919674

[51] Int. Cl.[5] ..... H01J 29/07

[52] U.S. Cl. ..... 313/407; 313/408

[58] Field of Search ..... 313/407, 408, 402

[56] References Cited

U.S. PATENT DOCUMENTS

| | | | |
|---|---|---|---|
| 3,553,516 | 1/1970 | Kautz | 313/85 |
| 3,772,555 | 11/1973 | McKee et al. | 313/407 X |
| 3,808,493 | 4/1974 | Kawamura et al. | 313/407 X |
| 4,099,086 | 7/1978 | Röder et al. | 313/407 |
| 4,806,820 | 2/1989 | Berner et al. | 313/407 X |
| 4,950,945 | 8/1990 | Fendley et al. | 313/407 |

FOREIGN PATENT DOCUMENTS

| | | | |
|---|---|---|---|
| 0004245B1 | 9/1979 | European Pat. Off. . | |
| 2602240A1 | 7/1977 | Fed. Rep. of Germany . | |
| 2826881B2 | 7/1981 | Fed. Rep. of Germany . | |
| 2134436 | 12/1972 | France . | |
| 165327 | 10/1972 | Netherlands | 313/407 |

OTHER PUBLICATIONS

JP 60 63856 A: Patent Abstracts of Japan, E-335, Aug. 14, 1985, vol. 9, No. 197.

JP 61 18836 A: Patent Abstracts of Japan, E-471, Jan. 17, 1987, vol. 11, No. 17.

JP 62 223948 A: Patent Abstracts of Japan, E-592, Mar. 23, 1988, vol. 12, No. 89.

*Primary Examiner*—Palmer C. DeMeo

*Attorney, Agent, or Firm*—Ware, Fressola, Van Der Sluys & Adolphson

[57] ABSTRACT

In a combined mask/frame for a colour picture tube, a mask is attached to a frame by means of spot welds which are positioned at the corners and adjacent to the long center axis and the short center axis. Of central importance is the fact that all spot welds are arranged as double spot welds instead of single spot welds which were usual until now. The single spot welds of each double spot weld are located basically at the same height of the mask skirt but are slightly separated from each other.

18 Claims, 2 Drawing Sheets

COMBINED MASK-FRAME WITH DOUBLE SPOT WELDS

This is a continuation-in-part of copending application(s) Ser. No. 07/537,041 filed on Jun. 12, 1990, now abandoned.

BACKGROUND OF THE INVENTION

1. Field of the Invention

The invention relates to a combined mask-frame for a colour picture tube i.e. an arrangement with an approximately rectangular mask frame and a mask which is attached to the frame by means of spot welds.

2. Description of the Prior Art

Masks for colour picture tubes are drawn from special metal sheet which are provided with oblong holes. A mask skirt is formed during drawing and the mask surface is curved. The mask skirt is attached to the frame at eight or twelve spot welds by means of electric spot welding. As a rule, spot welds are placed adjacent to the short and long centre axes and at the corner points. With colour picture tubes with screen diagonals of more than approximately 20 inches, additional spot welds are placed on the long sides between the centre and the corners.

With respect to the properties of the joint between the mask and the frame, a high degree of rigidity is desirable to prevent the mask from being distorted by shocks and vibrating excessively as a result of sound waves such as those transmitted by a loudspeaker inside a television set. For other reasons a loose joint is desirable—especially because the mask and the frame have different expansion characteristics during tube manufacture and tube operation, especially at high cathode ray currents.

In order to meet these contradictory demands in the most effective way, the masks are provided with stiffening creases at certain points and with isolation slits at other points. Attention must be paid to the height of the spot welds in relation to the height of the mask skirt. Such general problems and a solution for them are described, e.g. in DE 31 15 799 A1.

This optimization problem, like all technical optimization tasks, is characterized by the desire to find an arrangement representing a compromise which is better than that offered by previous alternative solutions. In practical terms this means in the present case that for many years a solution has been sought to the problem of attaching a mask to its frame in such a way as to improve shock and vibration resistance while minimizing the effect of expansion due to heating on the colour display quality of the tube.

SUMMARY OF THE INVENTION

The combined mask/frame according to the invention is characterized by the fact that it has double spot welds instead of single spot welds, these being at least adjacent to the long axis of the combination. The double spot welds are arranged so that they are located at basically the same skirt height but are slightly separated from each other.

It is especially advantageous to use eight double spot welds, two adjacent to the short and long centre axes of the combination respectively and one double spot weld situated in each corner. In this case, the spot welds basically required until now between the centre and the corners of each long side can be omitted, even in combinations for very large tube types. Experience has shown that substantially better shock resistance as well as better heat expansion properties can be obtained with eight double spot welds instead of twelve single spot welds.

As a rule, the double spot welds are placed in the positions occupied by single spot welds in combinations known up to now. For example, the traditional spot weld in a corner or adjacent to one of the centre axes is retained and a second spot weld is placed a few millimeters alongside.

DETAILED DESCRIPTION OF THE PREFERRED EMBODIMENT

Figure 1B:
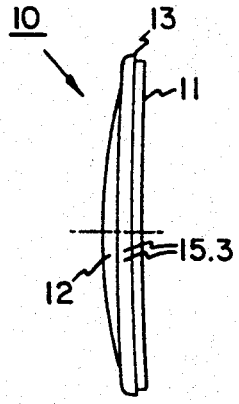
FIG. 1B schematic side view of the mask-frame of FIG. 1A.

The combined mask-frames 10 according to FIGS. 1A, 1B, 2 and 3 have an approximately rectangular frame 11 and a mask 12 with a curved perforated surface and a mask skirt 13. For the sake of clarity, only a few of the many oblong slots 14 present in each mask 12 are represented. Each of the masks 12 is attached to its frame 11 by means of spot welds, i.e twelve spot welds 15.1 to 15.12 in the arrangement according to FIGS. 1A and 1B and eight spot welds 15.2 to 15.4, 15.6, 15.8 to 15.10 and 15.12 in the application according to FIG. 2. In the application according to FIGS. 1A and 1B, the spot welds 15.3 and 15.9 adjacent to the long centre axis 16.1 are arranged as double spot welds; all other spot welds are single spot welds. In the application according to FIG. 2, all eight spot welds are double spot welds.

Figure 2:
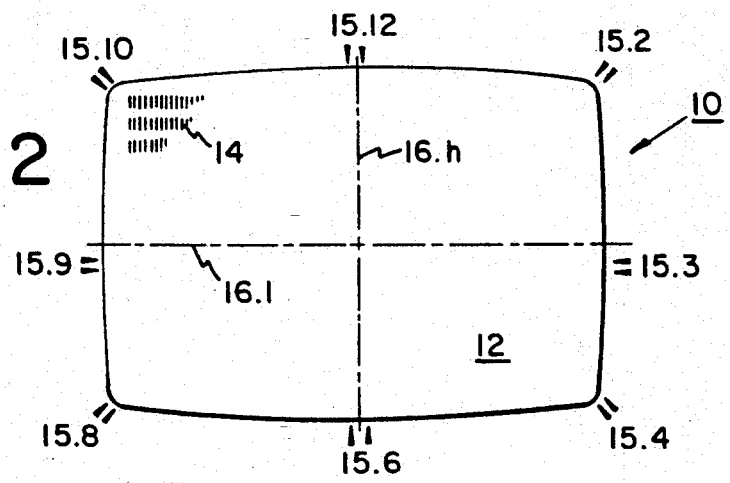
FIG. 2 a schematic top view of a combined mask-frame for a colour picture tube, with eight double spot welds.
Figure 3:
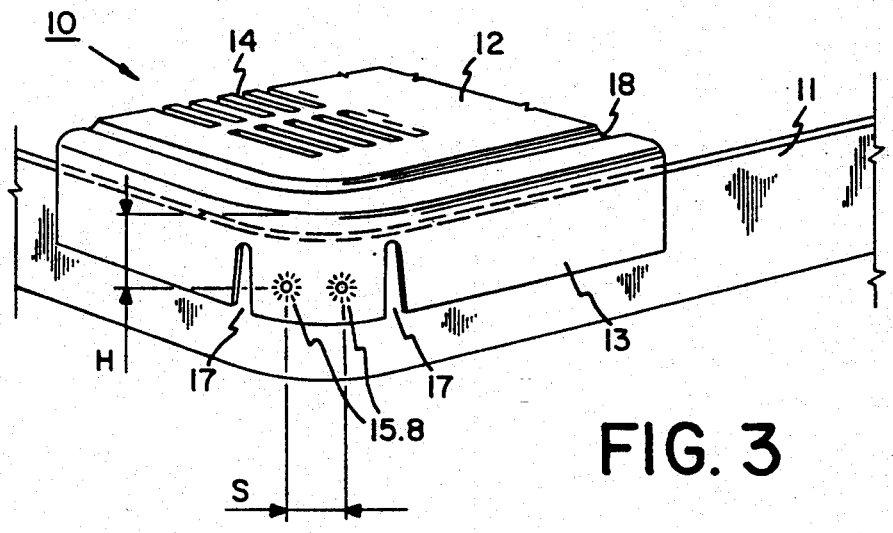
FIG. 3 perspective view of a corner area of a combined mask-frame.

In FIG. 3, the position of a double spot weld i.e. the spot weld 15.8 in the bottom left-hand corner of the arrangement in FIG. 2 is represented in detail. The two single spot welds are separated from each other by a distance S of about 5 mm. They are situated at the same height H in relation to the bend line between the mask skirt 13 and the perforated mask surface. Both spot welds are situated in a corner area which, to a certain extent, is mechanically detached from the other areas of the mask skirt 13 by cut-outs 17. These cut-outs 17 help to reduce mechanical tensions which occur when the heat expansion of the mask during manufacture or tube operation is different to that of the frame. The mask is weakened at this point but the perforated surface is strengthened by a crease 18 which runs around its edge. The addition of the cut-outs 17 and the crease 18, and the positioning of the spot welds are measures known from the state of the art. The exact position of the spot welds especially depends on the point where the joints between the frame 11 and a front glass trough (not represented) are situated. The spot welds are preferably placed at points adjacent to pins in the glass trough which strengthen the frame. These pins are typically offset in relation to the center axes by a few millimeters to a few tens of millimeters. This is the reason why spot welds are also generally situated not exactly on the centre axes but adjacent to them.

The described combined mask/frames are different from known combinations of this kind only in that various spot welds are arranged as double spot welds. Each single spot weld at a double spot weld has basically the dimension of a traditional spot weld i.e. a diameter of slightly over one millimeter. In the preferred application example, the single spot welds of a double spot weld are separated from each other by approximately 5 mm. In the case of the right-hand double spot weld 15.3, for example, the upper spot weld is situated in the traditional position, i.e. about 45 mm below the long centre axis 16.1, and the lower spot weld is situated 5 mm below this axis. The "upper" and "lower" spot weld specifications relate to the representation according to FIGS. 1A, 1B and 2; in fact the spots are situated at the same height H in relation to the height of the mask skirt, as described above (FIG. 3).

Figure 4:
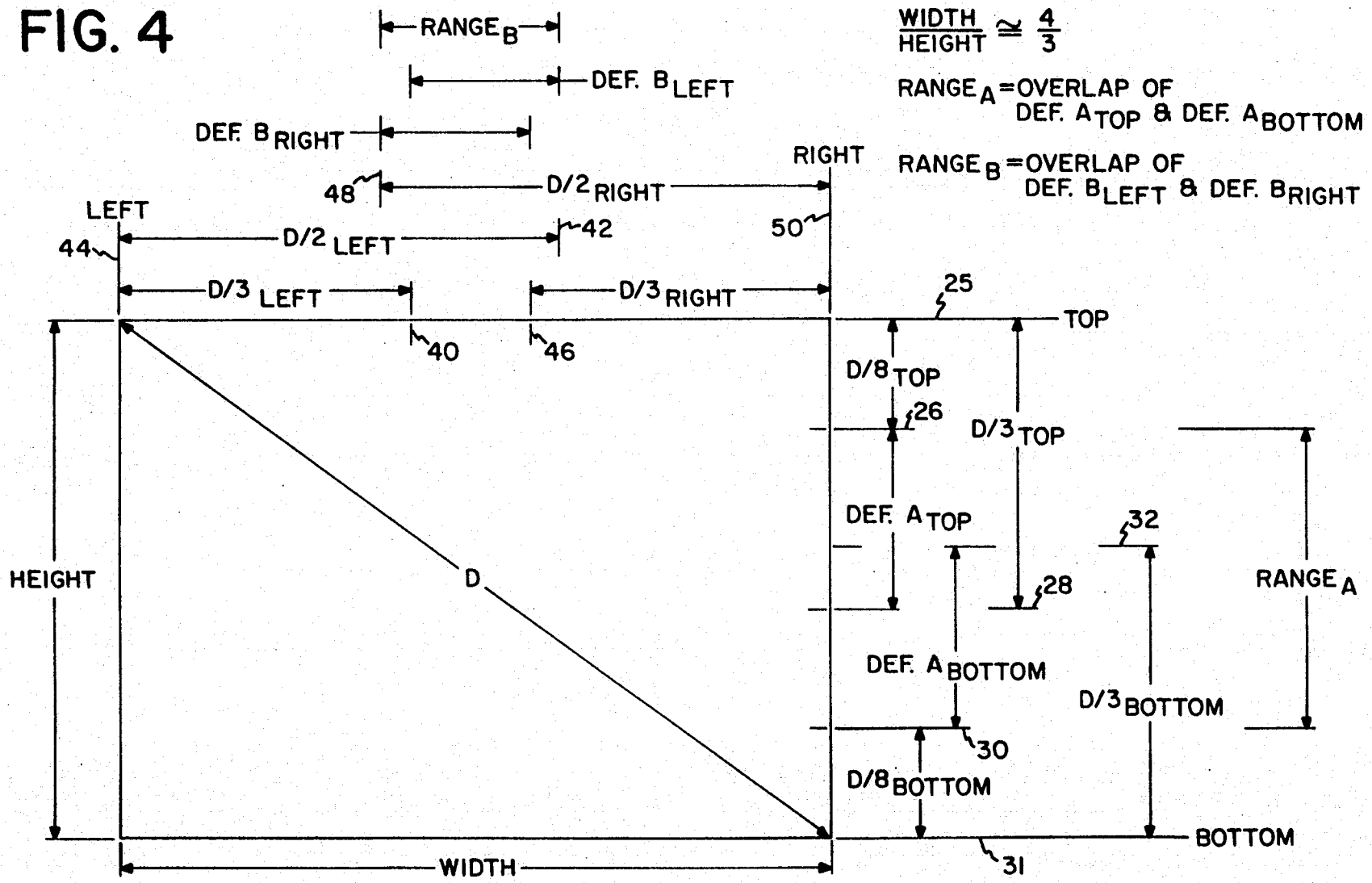
FIG. 4 is an illustration of ranges within which double welds may be arranged, according to the present invention, to avoid having to place any intermediate welds between the double welds and the corners.

In FIG. 4, a diagram is shown of a typical 4:3 aspect ratio television screen in which the width is four units wide and the height is three units high. According to the present invention, the double welds of FIGS. 1 and 2, if positioned to be within the width $RANGE_B$, or within the height $RANGE_A$, or both, there is no need for any additional welds between the double welds and the corner welds. The $RANGE_A$ is defined, along the height of the screen, as covering a range $DEF.A_{TOP}$ and range $DEF.A_{BOTTOM}$. The $DEF.A_{TOP}$ and range is defined, as measured rom a top edge 25, as falling between a line 26 which is a distance of D/8 from the line 25 and a line 28 falling a distance D/3 from the line 25, both measured vertically downwards from the top line 25. The range $DEF.A_{BOTTOM}$ is defined as falling between a line 30 being a distance D/8 from a line 31 at the bottom edge of the screen as measured vertically upwards therefrom, and a similarly measured line 32 at a distance D/3 from the bottom line 31.

Similarly, a $RANGE_B$ covers a range $DEF.B_{LEFT}$ and a range $DEF.B_{RIGHT}$. The $DEF.B_{LEFT}$ range is defined as the range between a line 40 and a line 42 measured, respectively, at distances of D/3 and D/2 from a line 44 at the left vertical edge of the screen. Similarly, the range $DEF.B_{RIGHT}$ is defined as covering the range between a line 46 and a line 48 at distances D/3 and D/2, respectively, from a line 50 at the right vertical edge of the screen.

If the double weld 15.3 or 15.9 is placed in the $RANGE_A$, then there is no need for any additional welds between it and the corner welds 15.2 and 15.4, or 15.10 and 15.8. Similarly, if either of the welds 15.3 or 15.9 is placed within the $RANGE_A$, or if any of the double welds 15.6 or 15.12 is placed within the $RANGE_B$, then there is not need for any additional welds between those particular double welds and the associated corner welds on either side thereof.

Figure 1A:
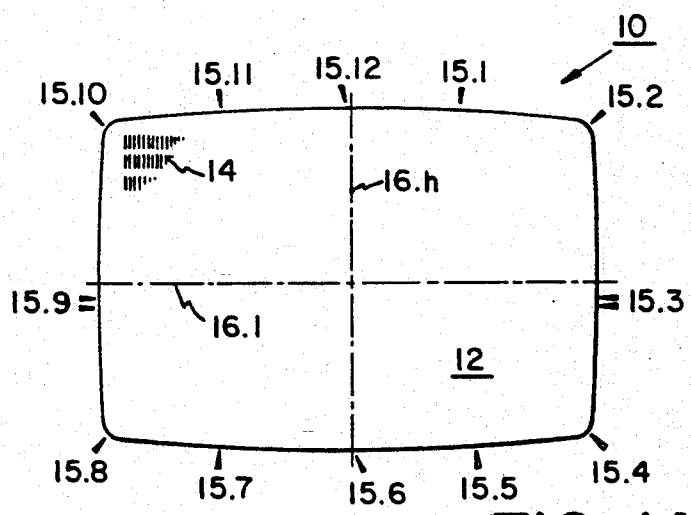
FIG. 1A schematic top view of a combined mask-frame for a colour picture tube, with ten single spot welds and two double spot welds.

In traditional combined mask/frames for tubes with a screen diagonal greater than approximately 20 inches, twelve single spot welds are placed at the points according to FIGS. 1A and 1B. In combinations for tubes with smaller diagonals, eight spot welds are placed at the points according to FIG. 2. If double spot welds are used throughout instead of single spot welds, it is also possible to achieve the same optimum effects for tubes with very large screen diameters of 27 inches and more with only eight spot welds arranged as double spot welds. In combinations for small tubes a definite optimization of properties results when six single spots are used instead of the previous eight single spot welds. However, the spot welds adjacent to the long centre axis are arranged as double spot welds. In combinations for tubes with screen diagonals greater than 20 inches, the arrangement according to FIGS. 1A and 1B with twelve spot welds, those adjacent to the long centre axis being double spot welds, can be used but experience has shown that the arrangement according to FIG. 2 is more advantageous.

I claim:

1. A combined mask-frame for a colour picture tube, comprising:

an approximately rectangular mask frame;

a mask made from an apertured metal plate with a turned-down skirt and attached at corners by spot welds to the frame; and double spot welds only in between the spot welds at at least two of the corners by which the mask skirt and therefore the mask is attached to the frame, which double spot welds lie at basically the same skirt height but are separated from each other by several millimeters.

2. A combined mask-frame according to claim 1, wherein only double spot welds are present as spot welds at the corners and adjacent to the long centre axis as well as a short centre axis.

3. A combined mask-frame according to claim 2, wherein the double spot welds adjacent the long centre axis are positioned approximately 45 mm from the long centre axis.

4. A combined mask-frame according to claim 3, wherein the spot welds of the double spot welds are spaced approximately 5 mm apart.

5. A combined mask-frame according to claim 1, wherein the double spot welds are positioned approximately 45 mm from the long centre axis.

6. A combined mask-frame according to claim 5, wherein the spot welds of the double spot welds are positioned approximately 5 mm from each other.

7. A combined mask-frame according to claim 1, wherein the mask-frame has a long side-short side aspect ratio of about 4/3 and wherein the double spot welds in between the corner spot welds located at a pair of corners at opposite ends of the long side of the combined mask-frame are located within a range as measured from either corner along the long side of between D/2 and D/3, where D is a diagonal of the mask-frame.

8. A combined mask-frame according to claim 1, wherein the mask-frame ha a long side-short side aspect ratio of about 4/3 and wherein the double spot welds in between the corner spot welds located at a pair of corners at opposite ends of the short side of the combined mask-frame are located within a range as measured from either corner along the short side of between D/8 and D/3, where D is a diagonal of the mask-frame.

9. A combined mask and frame for a four cornered rectangular colour picture tube having a screen diagonal greater than 50 cm, wherein only double spot welds are present as spot welds joining the mask and frame at the corners and adjacent to mutually perpendicular long and short centre axes which bisect the diagonal at their intersection.

10. A combined mask and frame for a four cornered rectangular colour picture tube having long and short sides and a diagonal of less than 50 cm, wherein single sport welds joining the mask and frame are present at the four corners and adjacent to a short centre axis parallel to the short sides of the frame and intersecting centres of the long sides, while double spot welds joining the mask and frame lie adjacent to a long centre axis parallel to the long sides of the frame and intersecting centres of the short sides.

11. A combined mask-frame (10) for a colour picture tube with an approximately rectangular mask frame (11) having a diagonal less than approximately fifty centimeters, a mask (12) made form an apertured metal sheet with a turned down skirt (13), and spot welds (15.1 to 15.12) by which the mask skirt and therefore the mask are attached to the frame, wherein the spot welds (15.3, 15.9) which are adjacent to a long centre axis (16.1) of the combined mask-frame (10) are arranged as double spot welds which lie at basically a same skirt height (H) but are slightly separated from each other, and wherein the double spot welds (15.23 and 15.9) are the only welds between corner welds (15.2, 15.4 and 15.8, 15.10), respectively.

12. A combined mask-frame according to claim 11, wherein the spacing between the two single spot welds of a double spot weld is a few millimeters.

13. A combined mask-frame according to claim 12, wherein the spacing between the two single spot welds of the double spot weld is approximately 5 mm.

14. The mask-frame (10) of claim 11, wherein the spacing between the two single spot welds of a double spot weld is several millimeters.

15. A combined mask-frame (10) for a colour picture tube with an approximately rectangular mask frame (11) having long and short sides and a diagonal greater than approximately fifty centimeters, a mask (12) made from an apertured metal sheet with a turned down skirt (13), and spot welds by which the mask skirt and therefore the mask are attached to the frame, wherein the spot welds only include spot welds (15.2 to 15.4, 15.6, 15.8 to 15.10, 15.12) at corners of the mask frame (11) and adjacent to a long centre axis (16.l) bisecting the short sides as well as a short central axis (16.h) bisecting the long sides and which are all arranged as double spot welds which lie at basically a same skirt height (H) but are slightly separated from each other.

16. A combined mask-frame according to claim 15, wherein the spacing between the two single spot welds of a double spot weld is a few millimeters.

17. A combined mask-frame according to claim 16, wherein the spacing between the two single spot welds of the double spot weld is approximately 5 mm.

18. The mask-frame (10) of claim 15, wherein the spacing between the two single spot welds of a double spot weld is several millimeters.

* * * * *

UNITED STATES PATENT AND TRADEMARK OFFICE

CERTIFICATE OF CORRECTION

PATENT NO. : 5,218,265

DATED : June 8, 1993

INVENTOR(S) : Reidinger

It is certified that error appears in the above-identified patent and that said Letters Patent is hereby corrected as shown below:

On the title page: Item

[75,] please change "Ortsstrasse" to --Ebersbach--.

column 4, line 51, please change "ha" to --has--; and at line 68, please change "sport" to --spot--.

column 5, line 18, please change "15.23" to --15.3--.

Signed and Sealed this

Twenty-second Day of March, 1994

*Attest:*

*Attesting Officer*

BRUCE LEHMAN

*Commissioner of Patents and Trademarks*